US006033740A

United States Patent [19]

Oelbrandt et al.

[11] Patent Number: 6,033,740

[45] Date of Patent: Mar. 7, 2000

[54] METHOD FOR MAKING POSITIVE WORKING PRINTING PLATES FROM A LITHOGRAPHIC BASE COMPRISING A FLEXIBLE SUPPORT HAVING A HARDENED HYDROPHILIC SUBSTRATE

[75] Inventors: Leo Oelbrandt, Kruibeke; Luc Leenders, Herentals; Stefaan De Meutter, Antwerp; Luc Vanmaele, Lochristi, all of Belgium

[73] Assignee: Agfa-Gevaert, N.V., Mortsel, Belgium

[21] Appl. No.: 09/212,390

[22] Filed: Dec. 16, 1998

Related U.S. Application Data

[60] Provisional application No. 60/074,131, Feb. 9, 1998.

[30] Foreign Application Priority Data

Dec. 18, 1997 [EP] European Pat. Off. ..... 97204015

[51] Int. Cl.[7] ..... B05D 1/02; B05D 5/04; B05D 3/06

[52] U.S. Cl. ..... 427/511; 427/256; 427/261; 101/465

[58] Field of Search ..... 101/465–467; 427/256, 258, 261, 288, 466, 301–303, 508, 511

[56] References Cited

U.S. PATENT DOCUMENTS

| | | |
|---|---|---|
| 5,312,654 | 5/1994 | Arimatsu et al. . |
| 5,501,150 | 3/1996 | Leenders et al. . |
| 5,511,477 | 4/1996 | Adler et al. . |
| 5,750,314 | 5/1998 | Fromson et al. . |
| 5,820,932 | 10/1998 | Hallman et al. . |
| 5,852,975 | 12/1998 | Miyabe et al. . |

FOREIGN PATENT DOCUMENTS

| | | |
|---|---|---|
| 9-058144 | 3/1997 | Japan . |

*Primary Examiner*—Fred J. Parker
*Attorney, Agent, or Firm*—Breiner & Breiner

[57] ABSTRACT

According to the present invention there is provided a method for making lithographic printing plates including the steps of dispensing in a predetermined pattern curable hydrophobic ink from a printhead of a printer onto a lithographic base or polymerizable ink from a printhead of a printer onto a lithographic base which is coated with a polymerization initiator by spraying droplets of the ink onto the lithographic base in the predetermined pattern and curing the sprayed droplets of the ink upon the lithographic base, characterized in that the lithographic base comprises a flexible support having a cross-linked hydrophilic surface.

9 Claims, No Drawings

METHOD FOR MAKING POSITIVE WORKING PRINTING PLATES FROM A LITHOGRAPHIC BASE COMPRISING A FLEXIBLE SUPPORT HAVING A HARDENED HYDROPHILIC SUBSTRATE

This application claims the benefit of U.S. Provisional Application No. 60/074,131 filed Feb. 9, 1998.

FIELD OF THE INVENTION

The present invention relates to methods for making lithographic printing plates. In particular, it relates to a method for directly making the lithographic printing plates by using inkjet printing, which makes it possible to produce the lithographic plates directly from digital data output from computers, facsimiles, or the like without using any films having negative or positive images.

BACKGROUND OF THE INVENTION

Digitalization of information has made a rapid progress in recent years throughout the process from manufacturing a block copy, an upper stream process of printing, to manufacturing a printing plate, thereby putting to practical use for example, a photographic form system of characters, by which a block copy of manuscripts can be readily prepared, or a scanner which directly reads picture images. With this progress, there has arisen a demand for a direct plate-making method in which lithographic plates can be directly prepared from digital data output from computers, facsimiles, or the like without using a film for making printing plates.

As one example of the direct plate-making method, a method wherein an image or non-image portion is directly formed on a substrate by ink-jet printing is known to the art. The ink-jet printing system is a relatively rapid image output system and has a simple construction because it does not require any complex optical system. Therefore, the printing system makes an apparatus for making printing plates simple and the cost for making printing plates can be saved since the maintenance labor is largely reduced.

As examples of the methods for preparing printing plates by using the ink-jet printing system, Japanese Kokai Publication 113456/1981 proposes the methods for preparing printing plates wherein ink-repelling materials (e.g. curable silicone) are printed on a printing plate by ink-jet printing. The printing plate obtained by this method is an intaglio printing plate in which the ink-repelling material formed on the surface of the substrate serves as a non-image part. As a result, the resolution of the printed images at shadow area or reversed lines is not so good. Moreover, a large amount of ink is needed in this method because the ink-repelling material must be deposited on the whole non-image part which occupies most of the surface of the printing plate, thereby delaying the printing process.

Japanese Kokai Publication 69244/1992 discloses a method for making printing plates comprising the steps of forming a printed image on a recording material subjected to a hydrophilic treatment by ink-jet printing using a hydrophobic ink containing photocurable components; and exposing the whole surface to an active light. However, the surface of the substrate to be used for the lithographic plate is usually subjected to various treatments such as a mechanical graining, an anodizing or a hydrophilic treatment to obtain good hydrophilic property and water retention property. Therefore, even the use of an ink composition having a very high surface tension results in a poor image on the surface of the substrate because of ink spreading and low printing endurance. EP-A-533 168 discloses a method for avoiding said ink spreading by coating the lithographic base with an ink absorbing layer which is removed after ink printing. This is an uneconomical and cumbersome method.

OBJECTS OF THE INVENTION

It is an object of the invention to provide a method for making negative lithographic printing plates from a flexible lithographic base image-wise imaged with curable ink by a printer which yields an excellent lithographic printing plate with a good ink acceptance in the image areas and no ink acceptance in the non-image areas and a high printing endurance.

It is further an object of the present invention to provide a method for making negative lithographic printing plates without a wet development of the lithographic base in a rapid, economically and ecological way.

Further objects of the present invention will become clear from the description hereinafter.

SUMMARY OF THE INVENTION

According to the present invention there is provided a method for making lithographic printing plates including the steps of dispensing in a predetermined pattern curable hydrophobic ink from a printhead of a printer onto a lithographic base or polymerizable ink from a printhead of a printer onto a lithographic base which is coated with a polymerization initiator by spraying droplets of the ink onto the lithographic base in the predetermined pattern and curing the sprayed droplets of the ink on the lithographic base, characterized in that the lithographic base comprises a flexible support having a cross-linked hydrophilic surface.

DETAILED DESCRIPTION OF THE INVENTION

According to the present invention there is provided a method for making lithographic printing plates including the steps of dispensing in a predetermined pattern actinic light curable hydrophobic ink from a printhead of a printer onto a lithographic base or polymerizable ink from a printhead of a printer onto a lithographic base which is coated with a photopolymerization initiator by spraying droplets of the ink onto the lithographic base into the predetermined pattern and curing by actinic light irradiation the sprayed droplets of the ink upon the lithographic base, characterized in that the lithographic base comprises a flexible support having a cross-linked hydrophilic surface.

According to the present invention, the lithographic base having a cross-linked hydrophilic surface comprises a flexible support, such as e.g. paper or plastic film, provided with a cross-linked hydrophilic layer. A particularly suitable cross-linked hydrophilic layer may be obtained from a hydrophilic binder cross-linked with a cross-linking agent such as formaldehyde, glyoxal, polyisocyanate or a hydrolysed tetraalkyl orthosilicate. The latter is particularly preferred; most preferred is tetraethyl or tetramethyl orthosilicate.

As hydrophilic binder there may be used hydrophilic (co)polymers such as for example, homopolymers and copolymers of acrylamide, methylol acrylamide, methylol methacrylamide, acrylic acid, methacrylic acid, hydroxyethyl acrylate, hydroxyethyl methacrylate, maleic anhydride/vinylmethylether copolymers, gelatin, polyvinylpyrrolidone, hydroxyethylcellulose, hydroxypropylcellulose, carboxymethylcellulose, polysaccharides and starch. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight. A preferred hydrophilic binder is polyvinylalcohol.

The amount of crosslinking agent, in particular of tetraalkyl orthosilicate, is preferably at least 0.2 parts by weight per part by weight of hydrophilic binder, more preferably between 0.5 and 5 parts by weight, most preferably between 1.0 parts by weight and 3 parts by weight.

A cross-linked hydrophilic layer in a lithographic base used in accordance with the present embodiment preferably also contains substances that increase the mechanical strength and the porosity of the layer. For this purpose colloidal silica may be used. The colloidal silica employed may be in the form of any commercially available water-dispersion of colloidal silica for example having an average particle size up to 40 nm, e.g. 20 nm. In addition inert particles of larger size than the colloidal silica can be added e.g. silica prepared according to Stöber as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the cross-linked hydrophilic layer is given a uniform rough texture consisting of microscopic hills and valleys, which serve as storage places for water in background areas.

The thickness of a cross-linked hydrophilic layer in a lithographic base in accordance with this embodiment may vary in the range of 0.2 to 25 $\mu$m and is preferably 1 to 10 $\mu$m.

Particular examples of suitable cross-linked hydrophilic layers for use in accordance with the present invention are disclosed in EP-A- 601 240, GB-P- 1 419 512, FR-P- 2 300 354, U.S. Pat. No. 3,971,660, U.S. Pat. No. 4,284,705 and EP-A- 514 490.

As flexible support of a lithographic base in connection with the present embodiment it is particularly preferred to use a plastic film e.g. subbed polyethylene terephthalate film, cellulose acetate film, polystyrene film, polycarbonate film etc. The plastic film support may be opaque or transparent.

It is particularly preferred to use a polyester film support to which an adhesion improving layer has been provided. Particularly suitable adhesion improving layers for use in accordance with the present invention comprise a hydrophilic binder and colloidal silica as disclosed in EP-A- 619 524, EP-A- 620 502 and EP-A- 619 525. Preferably, the amount of silica in the adhesion improving layer is between 200 mg per $m^2$ and 750 mg per $m^2$. Further, the ratio of silica to hydrophilic binder is preferably more than 1 and the surface area of the colloidal silica is preferably at least 300 $m^2$ per gram, more preferably at least 500 $m^2$ per gram.

In one embodiment the curable hydrophobic ink to be used in the present invention usually contains as essential components a polymerizable compound having at least one ethylenically unsaturated double bond in the molecule with the exception of compounds having a vinylether group and a polymerization initiator. In the polymerizable ink composition according to the present invention, linear organic polymers, volatilization preventive agents, surfactants, heat polymerization inhibitors, coupling agents, dyes, viscosity adjusting agents and other additives (e.g. plasticizers) are further added, if necessary.

The polymerizable compounds are the compounds characterized by having at least one ethylenically unsaturated double bound which are cured by radical addition polymerisation initialised by a polymerization initiator activated by addition of energy such as actinic light or heat. These compounds include mono- and polyunsaturated carboxylic acids such as acrylic acid, methacrylic acid, itaconic acid and maleic acid; esters of polyhydroxy compounds such as ethylene glycol, tetraethylene glycol, neopentylglycol, propylene glycol, 1,2-butanediol, trimethylolpropane, pentaerythritol and dipentaerythritol and the like with the above-described unsaturated carboxylic acids; adducts of epoxides such as trimethylolpropane polyglycidylether, pentaerythritol polyglycidylether, propylene glycol diglycidylether, reaction product of epichlorohydrin with 2,2-bis(4-hydroxyphenyl)propane, diglycidylester of phthalic acid and the like with the above-described unsaturated carboxylic acids; and acrylamides and methacrylamides such as acrylamide, ethylene bis-acrylamide, ethylene bis-methacrylamide and hexamethylene bis-methacrylamide; and the like. Acrylic acid esters, methacrylic acid esters, acrylamides and methacrylamides are preferable. These photopolymerizable compounds are present in the photopolymerizable ink compositions according to the present invention in an amount of 20 to 99.9% by weight, preferably 25 to 99% by weight, more preferably 30 to 98% by weight. When the content of the photopolymerizable compounds is less than 20% by weight, the printing durability of the printing plate obtained will be deteriorated.

The polymerisation initiators are the compounds which generate radicals under the influence of added energy, preferably actinic light.

The photopolymerization initiators used in actinic light curable inks according to the first embodiment are the compounds which generate radical species by absorbing the light from ultraviolet and visible, and the compounds listed below can be used alone or in combination with each other. They are benzophenones such as benzophenone, methyl o-benzoylbenzoate, N,N'-tetraethyl4,4'-diaminobenzophenone, Michler's ketone and thio-Michler's ketone; phenylglyoxal ethers, acetophenones such as 2,2 dimethoxyacetophenone, 2,2-diethoxyacetophenone, 2,2-dimethoxy-2-phenylacetophenone, a hydroxycyclohexyl phenyl ketone, 2-hydroxy-2-methyl-1-phenylpropanone-1, 2-methyl-l-[4-(methylthio)phenyl-2-morpholinopropane-l; benzoins and their alkyl ethers such as benzoin, benzoin methyl ether, benzoin isopropyl ether and benzoin isobutylether; ethyl p-dimethylaminobenzoate; ethyl p-diethylaminobenzoate; thioxanthones such as thioxanthone, 2-ethylthioxanthone, 2,4-diethylthioxanthone and 2-chlorothioxanthone; 2-ethylanthraquinone; 9-phenylacridine; 9-p-methoxyphenylacridine; 9,10-dimethylbenzphenazine; 6,4',4"trimethoxy-2,3-diphenylquinoxaline; peroxides such as benzoyl peroxide, di-t-butyl peroxide, dicumyl peroxide and cumene hydroperoxide;, 2 -nitrofluorene; 2,4,6-triphenylpyrillium tetrafluoroborate; 2,4,6-tris(trichloromethyl)-1,3,5-triazine; N-aryl-a-amino acids such as N-phenylglycine and N-(p-chlorophenyl)glycine; and diaryliodonium salts such as diphenyliodonium salt and bis(p-chlorophenyl)iodonium salt. In addition, polycyclic aromatic hydrocarbons such as anthracene, phenanthrene and perylene; coumarin series of dyes such as 3,3'-carbonylbiscoumarin; or dyes such as rose bengal and eosin; xanthene or thioxanthene dyes; and cyanine or merocyanine dyes can also be used. Of these compounds, those sensitized with visible light and having high sensitivity are preferable considering the fact that a light irradiation is carried out to cure selectively the photopolymerizable ink compositions after a printing image pattern has been formed with the ink-jet printing system. Examples of these compositions are described in Japanese Kokai Publications 114139/1982, 142205/1984, 180946/1988 and Japanese Patent Application Ser. No. 171068/1991. These photopolymerization initiators are used in an amount of from 0.1 to 50% by weight, preferably 1 to 30% by weight, more preferably 2 to 20% by weight in the photopolymerizable ink compositions according to the present invention. When the content of the photopolymerization initiator is less than 0.1% by weight, the printing durability of the printing plate decreases since curing of the image parts is insufficient or the curing time should be unpracticably long. Storage stability of the photopolymerizable ink compositions will be reduced when the content is above 50% by weight.

Additives, such as silane coupling agents can be added to the ink compositions according to the present invention to improve adhesion to the substrate described above. When a large amount of the compound having unsaturated double bonds is included in the photopolymerizable composition, the silane coupling agents having terminal groups such as vinyl, acryloyl and methacryloyl groups) are used preferably as described in Japanese Patent Application Ser. No. 2877511990. The silane coupling agent may be present in an amount of 0.1 to 15% by weight, preferably 0.5 to 10% by weight, more preferably 1 to 8% by weight.

A condensation product of diazodiphenylamine with paraformaldehyde conventionally used in the negative type PS plate (e.g. diazo compounds as described in Japanese Patent Application Ser. No.20919/1991) can be added to improve light curing properties of the photopolymerizable ink compositions formed on the substrate.

In a second embodiment the curable hydrophobic ink to be used in the present invention usually contains as essential components a cationic polymerizable compound having at least one vinylether group in the molecule and a polymerization initiator. In the polymerizable ink composition according to the present invention, linear organic polymers, volatilization preventive agents, surfactants, heat polymerization inhibitors, coupling agents, dyes, viscosity adjusting agents and other additives (e.g. plasticizers) are further added, if necessary.

The polymerizable compounds are the compounds which are able to cure the composition by addition polymerisation initialised by a polymerization initiator activated by addition of energy such as actinic light or heat. These compounds include vinylethers such as tri-ethyleneglycoldivinylether, octadecylvinylether, hexanedioldivinylether, n-butaanvinylether, 1,4-cyclohexanedimethyloldivinylether, epoxides and glycidyl ethers. Triethyleneglycoldivinylether and hexanedioldivinylether are preferred. These photopolymerizable compounds are preferably used as a mixture, preferably a mixture of triethyleneglycoldivinylether and hexanediolvinylether. These polymerizable compounds are present in the polymerizable ink compositions according to the present invention in an amount of 20 to 99.9% by weight, preferably 25 to 99% by weight, more preferably 30 to 98% by weight. When the content of the photopolymerizable compounds is less than 20% by weight, the printing durability of the printing plate obtained will be deteriorated.

The polymerisation initiators are the compounds which generate cationic species under the influence of addition of energy, preferably actinic light.

The photopolymerization initiators used in actinic light curable inks are the compounds which generate cationic species by absorbing the light from ultraviolet and visible, and said compounds can be used alone or in combination with each other. Said photopolymerization initiators are latent Bronsted acids. The term "latent Bronsted acid" refers to a precursor which forms a Bronsted acid by decomposition. The Bronsted acid is believed to catalyze the polymerization reaction. Typical examples of Bronsted acids which are suitable for this purpose are sulphonic acids e.g. trifluoromethane sulphonic acid and hexafluorophosphoric acid.

Ionic latent Bronsted acids are suitable for use in this invention. Examples of these include onium salts, in particular iodonium, sulfonium, phosphonium, selenonium, diazonium and arsonium salts.

Useful ionic latent Bronsted acids include those represented by the formula:

$$X^+R^1R^2R^3R^4W^-$$

When X is iodine then $R^3$ and $R^4$ are electron lone pairs and $R^1$ and $R^2$ each independently are aryl or substituted aryl groups. When X is S or Se then $R^4$ is an electron lone pair and $R^1$, $R^2$ and $R^3$ each independently can be an aryl group, a substituted aryl group, an aliphatic group or a substituted aliphatic group. When X is P or As, then $R^1$, $R^2$, $R^3$ and $R^4$ each independently can be an aryl group, a substituted aryl group, an aliphatic group or a substituted aliphatic group. W can be $BF_4$, $CF_3SO_3$, $SbF_6$, $CCl_3CO_2$, $ClO_4$, $AsF_6$, $PF_6$, or any corresponding acid whose pH is less than three.

Any of the onium salts described in U.S. Pat. No. 4,708,925 can be utilized as the latent Bronsted acid in this invention. These include iodonium, sulfonium, phosphonium, bromonium, chloronium, oxysulfoxonium, oxysulfonium, sulfoxonium, selenonium, telluronium and arsonium salts.

Use of iodonium and sulfonium salts as latent Bronsted acids is particularly preferred in this invention. They provide higher sensitivity in the ultraviolet region than other latent Bronsted acids.

Specific examples of particularly useful onium salts include:

diphenyliodonium hexafluorophosphate, 4,4' di(dodecyl-fenyl)-iodonium hexafluoroantimonate, triphenylsulfonium hexafluoroantimonate, trifenylsulfonium-hexafluorophosphate phenylmethyl-ortho-cyanobenzylsulfonium trifluoromethane sulfonate, and 2-methoxy-4-aminophenyl diazonium hexafluorophosphate Non-ionic latent Bronsted acids are also suitable for use in this invention. Examples of these include compounds of the formula $$RCH_2X,\ RCHX_2,\ RCX_3,\ R(CH_2X)_2 \text{ and } R(CH_2X)_3$$

wherein X is Cl, Br, F, or $CF_3SO_3$ and R is an aromatic group or an aliphatic group.

Further suitable non-ionic latent Bronsted acids are haloalkyl-substituted s-triazines as disclosed in EP-A 672954, o-quinone diazides, photo acid generating agents having an o-nitrobenzyl type protective group as described in Polymer Sci., by S. Hayase et al, 25, 573 (1987); the compounds which are subjected to a photodecomposition to generate a sulfonic acid, represented by iminosulfonates as described in Polymer Preprints Japan, by M. Tunooka et al, 35 (8), by disulfon compounds described in JP-Pi 61-166544, by a-sulphonyloxy ketones, by a-hydroxymethylbenzoine sulphonates, by nitrobenzyl sulphonates, by a-sulphonyl acetophenones and by sulphonyl imides, the preparation of these last compounds being well known in the literature; the compounds which are subjected to a photodecomposition to generate a phosphonic acid, a partly esterified phosphoric acid or phosphoric acid, represented by nitrobenzylphosphates or phosphonates as described in Tetrahedron Letters, by M. Rubinstein et al., 17, 1445 (1975), by benzoine phosphates or phosphonates, as described in J. Org. Chem. by M. Pirrung and S. Shuey, 59, 3890 (1994), by pyrenemethylphosphates or phosphonates, by iminophosphates or phosphonates and by imidophosphates or phosphonates, the preparation of these last compounds being well known in the literature.

Further, compounds in which the above photosensitive acid precursors are introduced into a primary chain or a side chain of a polymer can be used. Examples thereof include the compounds described in e.g. J.Am.Chem.Soc., by M. E. Woodhouse et al, 104, 5586 (1982); J.Imaging Sci., by S. P. Pappas et al, 30 (5), 218 (1986); etc.

These photopolymerization initiators are used in an amount of from 0.1 to 50% by weight, preferably 1 to 30% by weight, more preferably 2 to 20% by weight in the photopolymerizable ink compositions according to the present invention. When the content of the photopolymerization initiator is less than 0.1% by weight, the printing durability of the printing plate decreases since curing of the image parts is insufficient. Storage stability of the photopolymerizable ink compositions will be reduced when the content is above 50% by weight.

Thermally curable hydrophobic inks are mostly inks according to the first embodiment having as polymerization initiator preferably a peroxide and being free of a heat polymerization inhibitor.

In order to provide a balance of properties, the ink according to the invention may include some difunctional material e. g. in an amount of up to 70%, preferably 20 to 60%, more preferably 30 to 50% by weight of the formulation. For the same reason tri- or higher functional components may be present in the ink. If present, tri- or higher functional components will usually comprise up to 10% by weight of the formulation. More details are given in EP-A-465 039

The curable hydrophobic ink may contain a polar conductive element soluble in the polymerizable monomers. It has been found that not all conductive salts used in conventional ink formulation are suitable for this invention, since they may catalyse the breakdown of the photoinitiator. However, satisfactory polar salts have been identified, including potassium thiocyanate (most preferred). Other suitable conductive salts include lithium nitrate, lithium nitrate trihydrate, ammonium thiocyanate and dimethylamine hydrochloride The printing durability can be improved by improving the physical characteristics, such as strength and wear resistance of the polymerizable ink compositions according to both embodiments after curing. Linear organic polymers are blended with the polymerizable ink compositions according to the present invention to improve the physical characteristics of the polymerizable ink compositions after curing. Compounds which have a good compatibility with the above-described polymerizable compounds and which do not extremely increase the viscosity of the polymerizable ink compositions after the blending are preferable for such polymers. Examples of them are copolymers of (meth) acrylic acid with alkyl (meth)acrylates and/or (meth) acrylonitrile and the like; copolymers of itaconic acid with alkyl (meth)acrylates and/or (meth)acrylonitrile and the like; copolymers of crotonic acid with alkyl (meth)acrylate and/or (meth)acrylonitrile and the like; copolymers of vinyl acetate with alkyl (meth)acrylate; copolymers of partially esterified maleic acid with alkyl (meth)acrylates and/or (meth) acrylonitrile; copolymers of maleic anhydride with substituted or unsubstituted styrene, unsaturated hydrocarbons, and unsaturated ethers and/or unsaturated esters; esterification products of maleic anhydride copolymers; esterification products of copolymers having hydroxy groups with dicarboxylic anhydrides or polycarboxylic anhydrides; copolymers of hydroxyalkyl (meth)acrylate with alkyl (meth) acrylate and/or (meth)acrylonitrile and the like; copolymers of allyl alcohols with substituted or unsubstituted styrenes; copolymers of vinyl alcohols with alkyl (meth)acrylate or other polymerizable unsaturated compounds; modified compounds of acidic cellulose having carboxyl groups in their side chains; polyurethane (having a sufficient numbers of free OH groups); epoxy resins; polyesters; partially saponified vinyl acetate copolymers; polyvinylacetal having free OH groups; copolymers of hydroxystyrene with alkyl (meth) acrylate and the like; phenol/formaldehyde resins; polyethylene oxide, polyvinylpyrrolidone, or polyethers or polyamides of epichlorohydrin with 2,2-bis-(4-hydroxyphenyl) propane. Functional groups capable of cross-linking such as (meth)acryloyl group and cinnamoyl group can be contained in such linear organic polymers. The linear organic polymers may be used in the polymerizable ink compositions according to the present invention in an amount from 10 to 80% by weight, preferably 15 to 70% by weight, more preferably 20 to 50% by weight. When the content of the linear organic polymers is less than 10% by weight, effects of the improvement of the physical characteristics of the polymerizable ink compositions after curing are not sufficiently realized. When the content is over 80% by weight, on the other hand, the curing characteristics of the polymerizable ink compositions are decreased, thereby making the compositions unsuitable for the ink-jet system due to their viscosity increase.

A volatilization preventive agent is added to the polymerizable ink compositions according to the present invention, if necessary, to suppress evaporation of the ink solvent in the ink-jet nozzle and to prevent plugging due to precipitation of the dissolved components. Examples of the agent are bifunctional alcohols such as ethylene glycol, diethylene glycol, triethylene glycol, tetraethylene glycol, propylene glycol, dipropylene glycol and polyethylene glycol; trifunctional alcohols (e.g. glycerol). Glycerol is preferable among them. Two or more kinds of these polyfunctional alcohols can be used in combination with each other. The volatilization preventive agents are usually used in an amount from 0.5 to 40% by weight, preferably from 1 to 20% by weight, more preferably 2 to 15% by weight in the polymerizable ink compositions according to the present invention. When the content of the volatilization preventive agent is less than 0.5% by weight, it sometimes happens that a volatilization preventive effect can not be obtained sufficiently. When the amount is over 40% by weight, on the contrary, the physical characteristics of the polymerizable ink compositions deteriorate, thereby making the printing durability of the printing plate not so good.

A surfactant is preferably added to the polymerizable ink compositions according to the present invention to adjust the size of droplets of the polymerizable ink composition blowing out from the inkjet nozzle, to adjust the surface tension of the polymerizable ink composition so that images can be formed in high resolution, and to prevent spreading and repelling from occurring when the images are formed on the ink absorbing layer of the substrate. Any surfactants with which the surface tension of the polymerizable ink compositions can be adjusted to a desired value are acceptable, and they are not limited to anyone of nonionic, cationic or anionic compound. Use of the nonionic surfactants are preferable when a continuous type apparatus is used for forming the images in the ink-jet system, since the polymerizable ink compositions are required to be charged at the tip of the ink-jet nozzle and the charged ink droplets must be forced to deflect while they are passing through an electric field formed.

Examples of these surfactants to be used are polyethyleneglycol alkyl ethers or alkylphenyl ethers such as polyethyleneglycol lauryl ether and polyethyleneglycol nonylphenyl ether; fatty acid diethanolamides; sodium alkylnaphthalene sulfonate; polyethyleneglycol nonylphenyl ether sulfate; polyethyleneglycol lauryl ether triethanolamine sulfate; phosphates of polyethyleneglycol alkyl ether or alkylphenyl ether; or their combinations. The surfactant may be present in an amount of 0.1 to 5% by weight, preferably 0.2 to 4% by weight, more preferably 0.3 to 3% by weight. An amount of more than 0.1% by weight of these surfactants contained in the photopolymerizable ink compositions is sufficiently effective, and the amount of more than 5% by weight is too much since an increased amount of them will result in an insufficient curing of the polymerizable ink compositions.

Other components can be further added, if necessary, to the polymerizable ink compositions according to the present invention. For example, an amount of colorant e.g. a pigment or a or a mixture of pigments and/or dyes can be added to visualise the formed images; or heat polymerisation inhibitors, disinfectants, anticontamination agents and antifungal agents can be also added. A small amount of solvent like water may be added to adjust solubility of each component of the polymerizable ink composition and viscosity of it. Preferably no solvent is used. When solvent is used, the solvent may be present in an amount of 1 to 80% by weight, preferably 1 to 70% by weight, more preferably 1 to 50% by weight. When the content of the solvent is a little larger, the composition can be subjected to a drying process prior to the curing process. Use of buffers and solubilizers is effective to improve the solubility or dispersibility of the polymer. Addition of defoaming agents and foam suppressing agents are also possible to suppress foaming of the polymerizable ink compositions in the ink-jet nozzle.

Optionally other components that enhance the ink quality can be added.

These hydrophobic curable inks , certainly those used in the first embodiment presumably react with the hydrophilic binder during the curing by grafting and forming a covalent bond.

These two kinds of hydrophobic curable inks can also be hot melt inks comprising as polymerizable compound a phase change ink carrier composition. Said phase change ink carrier composition consist of a polymer or a mixture of polymers whereof the melting point is at least 50° C., more preferably at least 70° C. and most preferably at least 80° C.

The image forming requires the following steps. On demand, microdots of the curable hydrophobic ink are sprayed onto the lithographic base in a predetermined pattern as the plate passes through the printer. According to one embodiment of the invention, the microdots have a diameter of about 50 $\mu$m. In the following step the lithographic base sprayed with ink is cured by heat or preferably by irradiation with actinic light. Actinic light is light that is absorbed by the ink compositions and is capable of activating the curing of said ink. Preferably said actinic light is UV or visible light. The time needed for said curing depends of the intensity of the light in the plane of the lithographic base. For example said curing takes preferably between 2 and 5 seconds with a UV TL lamp of 60 W/cm. No further developing step is required.

In another embodiment of the invention an ink jet printhead suitable for curable hydrophobic ink is placed adjacent to the plate cylinder of an offset printing machine and directed to spray said ink onto a lithographic base held on the plate cylinder. A computer or other information source supplies graphics and textual information to the printhead via a lead. The ink on the lithographic base is then cured with heat or preferably actinic light yielding a ready to use printing plate.

The printing plate of the present invention can also be used in the printing process as a seamless sleeve printing plate. This cylindrical printing plate has such a diameter that it can be slided on the print cylinder. More details on sleeves are given in "Grafisch Nieuws" ed. Keesing, 15, 1995, page 4 to 6.

In another embodiment of the present invention the lithographic base is coated with a layer of polymerization initiator. Hereon is sprayed a polymerizable ink without a polymerization initiator in a predetermined pattern. The lithographic base is then subjected to heat or preferably actinic light irradiation and then washed to remove the hydrophilic polymerization initiator on the non-image areas.

The following examples illustrate the present invention without limiting it thereto. All parts and percentages are by weight unless otherwise specified.

EXAMPLE 1

Preparation of the Solution for the Subbing Layer

To a solution of 11.4 g of gelatine (viscosity: 19–21 mPas) in 940 ml of water was added 31.7 ml (11.4 g solid product) KIESELSOL 300 F. (tradename for 30% aqueous dispersion of colloidal silica—surface area of 300 $m^2$ per g). Anionic wetting agents (0.6 g) and biocides (1 g) were added.

Preparation of the Hydrophilic Layer

To 440 g of a dispersion containing 21.5% $TiO_2$ (average particle size 0.3 to 0.5 $\mu$m) and 2.5% polyvinyl alcohol in deionized water were subsequently added, while stirring, 250 g of a 5% polyvinyl alcohol solution in water, 105 g of a hydrolyzed 22% tetramethyl orthosilicate emulsion in water and 22 g of a 10% solution of a wetting agent. To this mixture was then added 183 g of deionized water and the pH was adjusted to pH=4.

Preparation of the Lithographic Base

To a polyethylene terephthalate support, coated with a primer containing 170 mg/$m^2$ of a latex of copoly (vinylidenechloride/methyl methacrylate/icatonic acid) and 40 mg/$m^2$ of silica with a surface area of 100 $m^2$/g was applied the above described solution for the subbing layer at a solids coverage of 750 mg/$m^2$. On top of the subbing layer was coated the above mentioned hydrophilic layer to a wet coating thickness of 50 g/$m^2$, dried at 30° C. and subsequently hardened by subjecting it to a temperature of 60° C. for 1 week.

Preparation of the Printing Ink

A mixture of a photopolymerizable hydrophobic ink is prepared by mixing 97.5% photopolymerizable monomer consisting of 75% RAPICURE CHVE (a trade name of ISP for 1,4-cyclohexanedimethyloldivinylether) and 25% hexanedioldivinylether with 2.5% of General Electric UV9310C (trade name for 4,4'di(dodecyl-fenyl)iodonium hexafluoroantimonaat).

Printing

With a suitable printer and the above mentioned ink an image was applied on the lithographic base. Said imaged lithographic base was then irradiated with an UV lamp of 60 watt/cm for 2 to 3 seconds. The plate is then used as a lithographic printing plate on an ABDick printing machine. As ink Van Son Rubberbase and as fountain solution 2% Tame was used. The printing copies were excellent from the fifth copy, showing a good ink acceptance in the image areas and no ink acceptance in the non-image areas.

EXAMPLE 2

A lithographic base prepared as in example 1 is coated with a solution of 10% of General Electric UV9310C (trade name for 4,4'di(dodecyl-fenyl)iodonium hexafluoroantimonaat) in ethanol at a thickness of 20 $\mu$m and dried for 10 minutes at 60° C. Said lithographic base is patternwise sprayed with a photopolymerizable hydrophobic ink consisting of 75% RAPICURE CHVE (a trade name of ISP for 1,4-cyclohexanemethyloldivinylether) and 25% hexanedioldivinylether. Said imaged lithographic base was then irradiated with an UV lamp of 60 watt/cm for 2 to 3 seconds. Afterwards the plate was rinsed with ethanol to remove the initiator on the non-imaged areas. The plate is then used as a lithographic printing plate on an ABDick printing machine. As ink Van Son Rubberbase and as fountain solution 2% Tame was used. The printing copies were excellent from the fifth copy, showing a good ink acceptance in the image areas and no ink acceptance in the non-image areas.

EXAMPLE 3

A lithographic base prepared as in example 1 is patternwise sprayed with a photopolymerizable hydrophobic ink consisting of 95% tripropaneglycoldiacrylate and 5% Irgacure 184 (a trade name of CIBA-GEIGY for 1-benzophenone-1hydroxyl-cyclohexane). Said imaged lithographic base was then irradiated with an UV lamp of 60 watt/cm for 2 to 3 seconds. The plate is then used as a lithographic printing plate on an ABDick printing machine. As ink Van Son Rubberbase and as fountain solution 2% Tame was used. The printing copies were excellent from the fifth copy showing a good ink acceptance in the image areas and no ink acceptance in the non-image areas. A high printing endurance is obtained

We claim:

1. A method for making lithographic printing plates including steps of dispensing in a predetermined pattern curable hydrophobic ink from a printhead of a printer onto a lithographic base by spraying droplets of the ink onto the lithographic base in the predetermined pattern and curing the droplets of the ink sprayed on the lithographic base, wherein the lithographic base comprises a flexible support having a cross-linked hydrophilic surface and the ink comprises an actinic light curable ink including as a polymerizable compound a phase change ink carrier composition.

2. A method for making lithographic printing plates according to claim 1 wherein said cross-linked hydrophilic surface comprises a hydrophilic binder.

3. A method for making lithographic printing plates according to claim 2 wherein said hydrophilic binder has a hydrophilicity which is the same as or higher than the hydrophilicity of polyvinyl acetate hydrolyzed to at least an extent of 60 percent by weight.

4. A method for making lithographic printing plates according to claim 3 wherein said hydrophilic binder is polyvinyl alcohol.

5. A method for making lithographic printing plates according to claim 1 wherein said cross-linked hydrophilic surface comprises a cross-linking agent.

6. A method for making lithographic printing plates according to claim 5 wherein said cross-linking agent is a hydrolyzed tetraalkyl orthosilicate.

7. A method for making lithographic printing plates according to claim 6 wherein said hydrolyzed tetraalkyl orthosilicate is tetramethyl orthosilicate or tetraethyl orthosilicate.

8. A method for making lithographic printing plates according to claim 1 wherein the curable hydrophobic ink contains as essential components a polymerizable compound having at least one ethylenically unsaturated double bond and no vinyl ether group, and a polymerization initiator.

9. A method for making lithographic printing plates according to claim 1 wherein the curable hydrophobic ink contains as essential components a polymerizable compound having at least one vinyl ether group, and a polymerization initiator.

* * * * *